US006916206B2

(12) United States Patent
Ferentz

(10) Patent No.: US 6,916,206 B2
(45) **Date of Patent: *Jul. 12, 2005**

(54) ACTIVE LOCAL AREA NETWORK CONNECTOR WITH LINE INTEROGATION

(75) Inventor: Alon Zeev Ferentz, Bat Yam (IL)

(73) Assignee: PowerOsine, Ltd., Hod Hasharon (IL)

( * ) Notice: Subject to any disclaimer, the term of this patent is extended or adjusted under 35 U.S.C. 154(b) by 0 days.

This patent is subject to a terminal disclaimer.

(21) Appl. No.: 10/854,149

(22) Filed: May 27, 2004

(65) Prior Publication Data

US 2004/0218324 A1 Nov. 4, 2004

Related U.S. Application Data

(62) Division of application No. 10/409,478, filed on Apr. 8, 2003, now Pat. No. 6,764,343.
(60) Provisional application No. 60/371,632, filed on Apr. 10, 2002.

(51) Int. Cl.[7] ..... H01R 13/66
(52) U.S. Cl. ..... 439/620; 439/676; 713/340; 713/310; 713/324; 700/250
(58) Field of Search ..... 439/620, 676, 439/76.1; 455/402; 713/310, 324, 340; 700/286; 709/250, 249

(56) References Cited

U.S. PATENT DOCUMENTS

| | | | | |
|---|---|---|---|---|
| 4,726,790 A | | 2/1988 | Hadjis | |
| 4,729,743 A | | 3/1988 | Farrar et al. | |
| 4,804,332 A | | 2/1989 | Piree | |
| 4,929,196 A | | 5/1990 | Ponn et al. | |
| 5,057,041 A | | 10/1991 | Yu et al. | |
| 5,094,629 A | | 3/1992 | Black et al. | |
| 5,102,354 A | | 4/1992 | Crane et al. | |
| 5,112,253 A | | 5/1992 | Swift | |
| 5,147,223 A | | 9/1992 | Black et al. | |
| 5,151,054 A | | 9/1992 | Brones et al. | |
| 5,158,482 A | | 10/1992 | Tan et al. | |
| 5,213,522 A | | 5/1993 | Kojima | |
| 5,224,878 A | | 7/1993 | Lurie et al. | |
| 5,266,054 A | | 11/1993 | Duncan et al. | |
| 5,286,221 A | | 2/1994 | Fenci et al. | |
| 5,344,342 A | | 9/1994 | Briones | |
| 5,397,250 A | | 3/1995 | Briones | |
| 5,587,884 A | * | 12/1996 | Raman | 361/728 |
| 5,647,767 A | | 7/1997 | Scheer et al. | |
| 5,687,233 A | * | 11/1997 | Loudermilk et al. | 379/442 |
| 5,865,648 A | | 2/1999 | Clyatt, III | |
| 5,872,492 A | * | 2/1999 | Boutros | 333/182 |
| 5,971,813 A | * | 10/1999 | Kunz et al. | 439/676 |
| 6,062,908 A | | 5/2000 | Jones | |
| 6,116,963 A | | 9/2000 | Shutter | |

(Continued)

FOREIGN PATENT DOCUMENTS

WO WO 96/24968 8/1996

*Primary Examiner*—Gary Pauman
(74) *Attorney, Agent, or Firm*—Simon Kahn

(57) ABSTRACT

An active local area network connector comprising: an active connector housing for use with local area network (LAN) equipment; first electrical contacts mounted in the housing and arranged for detachable connection with corresponding electrical contacts of at least one plugs, the first electrical contacts comprising at least one data pair for transmitting data between the local area network equipment and at least one LAN node; second electrical contacts mounted in the housing and arranged for connection with corresponding electrical contacts of the local area network equipment, the second electrical contacts carrying electrical power for the at least one LAN node; and active power circuitry located within the housing and coupled to at least one of the at least one data pair and at least one of the second electrical contacts, the active power circuitry comprising voltage measuring circuitry, the voltage measuring circuitry being employable for line interrogation.

28 Claims, 16 Drawing Sheets

U.S. PATENT DOCUMENTS 6,170,028 B1 * 1/2001 Wallach et al. ..... 710/302
6,176,741 B1 1/2001 Shutter
6,192,434 B1 * 2/2001 Wallach et al. ..... 710/302
6,193,560 B1 2/2001 Morana et al.
6,224,425 B1 5/2001 Shutter
6,304,929 B1 * 10/2001 Wallach et al. ..... 710/302
6,325,664 B1 12/2001 Someda et al.
6,332,166 B1 * 12/2001 Cranford, Jr. et al. ..... 709/250
6,473,608 B1 10/2002 Lehr et al. ..... 455/402
6,499,073 B1 * 12/2002 Wallach et al. ..... 713/340
6,522,515 B1 2/2003 Whitney
6,527,594 B1 3/2003 Korsunsky et al.
6,554,638 B1 * 4/2003 Hess et al. ..... 439/490
6,568,966 B1 5/2003 Korsunsky et al.
6,638,112 B1 10/2003 Walker et al.
6,643,566 B1 * 11/2003 Lehr et al. ..... 700/286
6,699,065 B1 3/2004 Espenshade et al.
6,709,295 B2 3/2004 Givens et al.
6,736,673 B1 * 5/2004 Simmons et al. ..... 439/541.5
6,790,097 B1 * 9/2004 Edwards et al. ..... 439/676

* cited by examiner

ACTIVE LOCAL AREA NETWORK CONNECTOR WITH LINE INTEROGATION

CROSS REFERENCE TO RELATED APPLICATION

The present application is a divisional of U.S. Pat. Ser. No. 6,764,343 issued Jul. 20, 2004, 10/409,478 filed Apr. 8, 2003, whose contents are incorporated herein by reference, which claims priority from U.S. Provisional Patent Application Ser. No. 60/371,632, filed Apr. 10, 2002, entitled "Active Connector".

FIELD OF THE INVENTION

The present invention relates to local area networks generally and more particularly to connectors useful in local area networks.

BACKGROUND OF THE INVENTION

The following U.S. patents are believed to represent the current state of the art: U.S. Pat. Nos. 6,062,908; 6,116,963; 6,325,664; 6,176,741; 6,193,560; 6,224,425; 4,726,790; 4,729,743; 4,804,332; 4,929,196; 5,057,041; 5,112,253; 5,865,648; 5,397,250; 5,094,629; 5,102,354; 5,147,223; 5,151,054; 5,158,482; 5,213,522; 5,224,878; 5,266,054; 5,286,221; 5,344,342; 6,473,608

The disclosures of all publications mentioned in the specification and of the publications cited therein are hereby incorporated by reference.

SUMMARY OF THE INVENTION

The present invention seeks to provide an improved active connector for use in a local area network.

There is thus provided, in accordance with a preferred embodiment of the present invention, an active local area network connector comprising: an active connector housing for use with local area network (LAN) equipment; first electrical contacts mounted in the housing and arranged for detachable connection with corresponding electrical contacts of at least one plugs, the first electrical contacts comprising at least one data pair for transmitting data between the local area network equipment and at least one LAN node; second electrical contacts mounted in the housing and arranged for connection with corresponding electrical contacts of the local area network equipment, the second electrical contacts carrying electrical power for the at least one LAN node; and active power circuitry located within the housing and coupled to at least one of the at least one data pair and at least one of the second electrical contacts, the active power circuitry comprising voltage measuring circuitry, the voltage measuring circuitry being employable for line interrogation. In a preferred embodiment, the voltage measuring circuitry comprises a voltage sensing resistor.

Further in accordance with a preferred embodiment of the present invention, the active connector also includes at least one RJ-45 socket arranged for selectably retaining at least one RJ-45 plug in electrical contact with the first plurality of first electrical contacts. The active connector may be RJ-45 compatible, RJ-21 compatible, or Ethernet compatible e.g. compatible with the IEEE 802.3 standard.

Further in accordance with a preferred embodiment of the present invention, the switch includes at least one active connector as described above.

Also provided, in accordance with a preferred embodiment of the present invention, is a local area network midspan device with integral power over LAN functionality, the midspan device including at least one active connector as described above.

Further in accordance with a preferred embodiment of the present invention, at least one of the first and second pluralities of contacts are arranged in signal pairs.

Still further in accordance with a preferred embodiment of the present invention, at least some of the first and second pluralities of electrical contacts are configured and operative to reduce crosstalk between the signal pairs.

Additionally in accordance with a preferred embodiment of the present invention, the housing is at least partially encapsulated in a metal shield.

Further in accordance with a preferred embodiment of the present invention, the connector also includes at least one socket arranged for selectably retaining at least one plug in electrical contact with the first plurality of first electrical contacts.

Still further in accordance with a preferred embodiment of the present invention, the at least one first plurality of electrical contacts includes multiple pluralities of first electrical contacts configured and operative to provide attachment of the active connector to at least one plugs.

Further in accordance with a preferred embodiment of the present invention, the at least one node includes multiple nodes and the active power control circuitry is operative to simultaneously control power to the plurality of nodes.

Still further in accordance with a preferred embodiment of the present invention, the active connector also includes at least one RJ-21 socket arranged for selectably retaining at least one RJ-21 plug in electrical contact with the first plurality of first electrical contacts.

Additionally in accordance with a preferred embodiment of the present invention, the Ethernet compatible active connector supports one of the following group of communication protocols: a 10baseT communication protocol; a 100baseT communication protocol; and a 1000baseT communication protocol.

Also provided, in accordance with a preferred embodiment of the present invention, is a local area network switch with integral power over LAN functionality, the switch including at least one active connector as described above.

Further provided, in accordance with a preferred embodiment of the present invention, is a local area network midspan device with integral power over LAN functionality, the midspan device including at least one active connector as described above.

Further in accordance with a preferred embodiment of the present invention, the active power control circuitry includes at least one of the following types of circuitry: application specific integrated circuitry (ASIC); FET circuitry; current sensing circuitry; voltage measuring circuitry; current limiting circuitry; and AC disconnecting circuitry.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
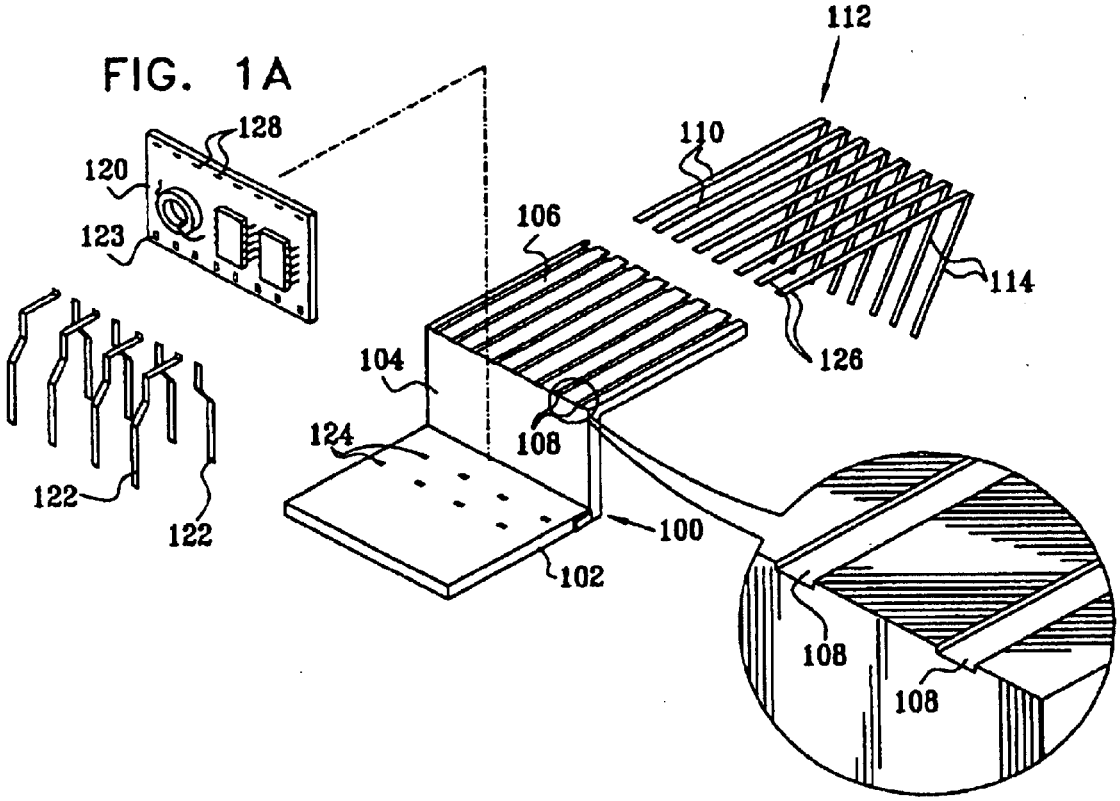
FIGS. 1A and 1B are respective exploded view and assembled pictorial illustrations of a connector element forming part of an active connector constructed and operative in accordance with a preferred embodiment of the present invention.
Figure 1B:
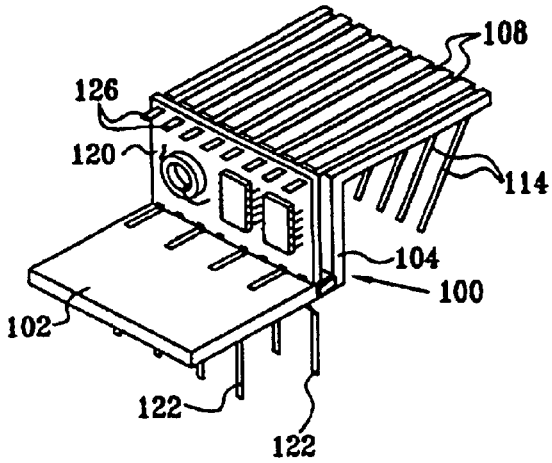

Reference is now made to FIGS. 1A and 1B, which are respective exploded view and assembled pictorial illustrations of an active connector element forming part of an active connector constructed and operative in accordance with a preferred embodiment of the present invention. The active connector element preferably comprises an insulative substrate 100, typically formed of plastic and having a step shape.

Substrate 100 preferably includes a first planar portion 102, which terminates in an upstanding portion 104. Upstanding portion 104 terminates in a second planar portion 106, which extends generally parallel to and offset from planar portion 102. Second planar portion 106 is preferably formed with a plurality of generally parallel extending elongate recesses 108 in which are preferably disposed principal elongate portions 110 of bent electrical contacts 112, which preferably also include shorter elongate portions 114 which are angled with respect to portions 110, typically by 30 degrees.

An electrical circuit board 120 onto which is formed an active electrical circuit, preferably as shown in any of FIGS. 4A–4D, is mounted onto substrate 100. Preferably a plurality of pins 122 is attached to circuit board 120. Pins 122 preferably extend through corresponding apertures 123 and 124 formed in the circuit board 120 and in the first planar portion 102, respectively.

Ends 126 of elongate portions 110 of contacts 112 preferably extend through-plated through apertures 128 on circuit board 120 and are soldered thereto, thus retaining circuit board 120 in position relative to substrate 100.

It is appreciated that the arrangement and configuration of conductors 110, pins 122 and circuit board 120 are preferably designed so as to minimize and to compensate for crosstalk. In such a case, conductors 110 may employ non-straight conductor portions. Conductors 110 are preferably constructed, configured and arranged to reduce cross talk between signal pairs.

It is appreciated that although the embodiment of FIGS. 1A and 1B specifically shows an RJ-45 active connector element, other types of active connector element may also be provided.

It will be appreciated that the present invention is not limited to the particular configuration of elements shown in FIGS. 1A and 1B or to any particular configuration of elements whatsoever, but rather extends to any LAN connector element including active electronic circuitry employed for controlling the supply of power over the LAN.

Figure 2A:
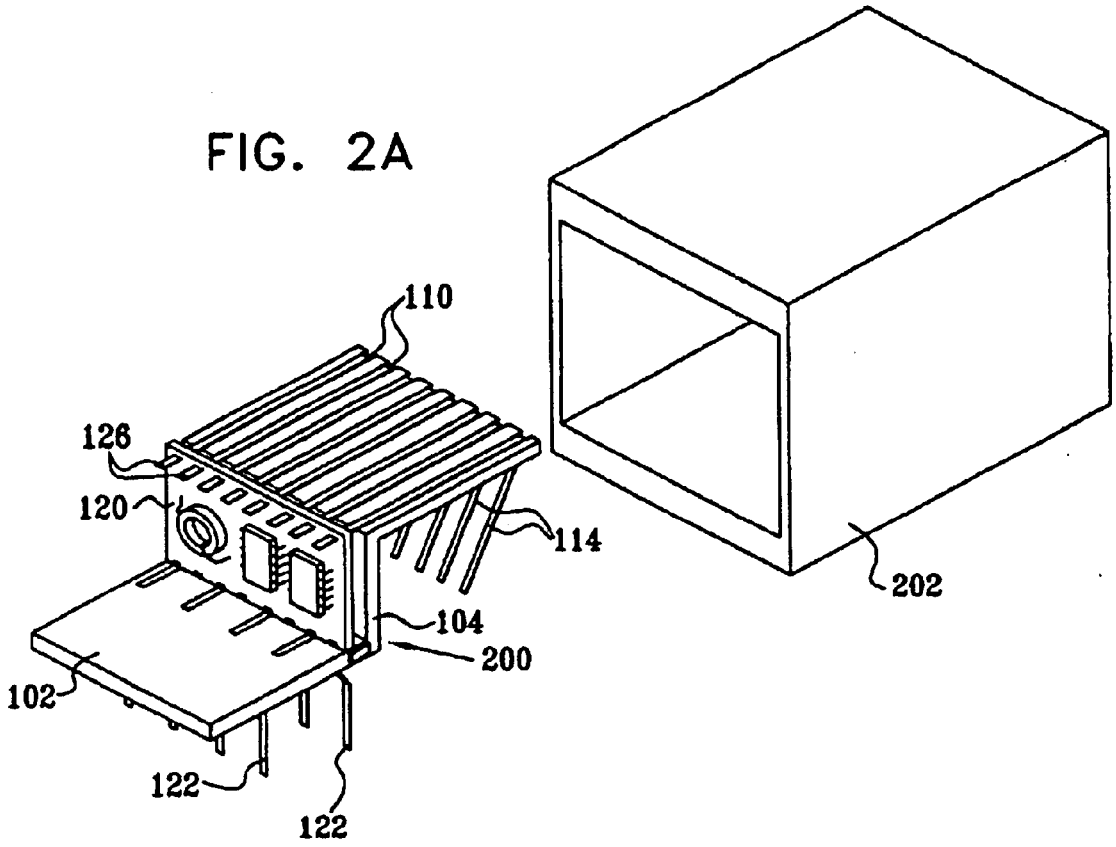
FIGS. 2A and 2B are respective exploded view and assembled pictorial illustrations of an active connector employing the connector element of FIGS. 1A and 1B, which is constructed and operative in accordance with a preferred embodiment of the present invention.
Figure 2B:
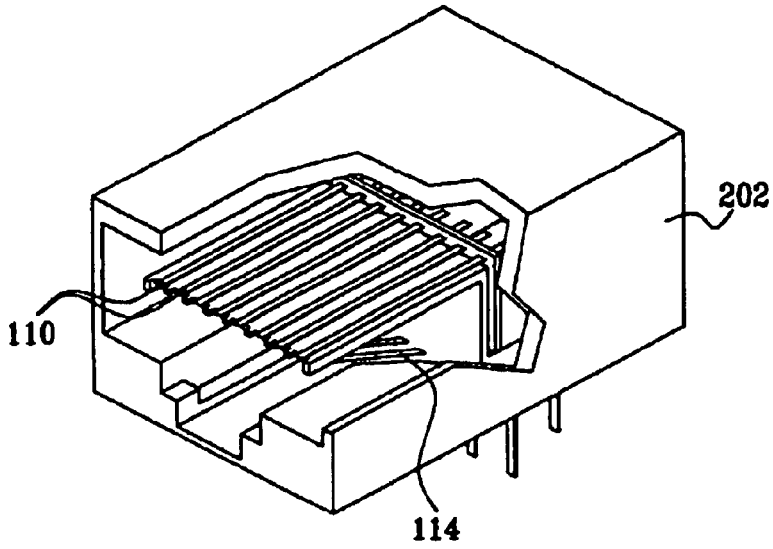

Reference is now made to FIGS. 2A and 2B, which are respective exploded view and assembled pictorial illustrations of an active connector employing the active connector element of FIGS. 1A and 1B, which is constructed and operative in accordance with a preferred embodiment of the present invention. As seen in FIGS. 2A and 2B, the active connector employs an active connector element 200, preferably of the type illustrated in FIGS. 1A and 1B, which is retained within an RJ-45 connector housing 202 by any suitable technique, such as the use of interengaging protrusions and sockets.

In the arrangement of FIGS. 2A and 2B, conductor portions 114 correspond to contacts of, thereby to engage, a conventional RJ-45 plug (not shown), while pins 122 are normally soldered onto a printed circuit board forming part of a local area network switch or other LAN equipment such as Ethernet hubs, nodes, IP telephones and wireless access points (not shown). In shielded LAN environment applications, the connector housing 202 is at least partially encapsulated in a metal shield (not shown) with contacts to provide shield continuity with mating plugs.

It will be appreciated that the present invention is not limited to the particular configuration of elements shown in FIGS. 2A and 2B or to any particular configuration of elements whatsoever, but rather extends to any LAN active connector including active electronic circuitry employed for controlling the supply of power over the LAN, whether or not shielding is provided.

Figure 3B:
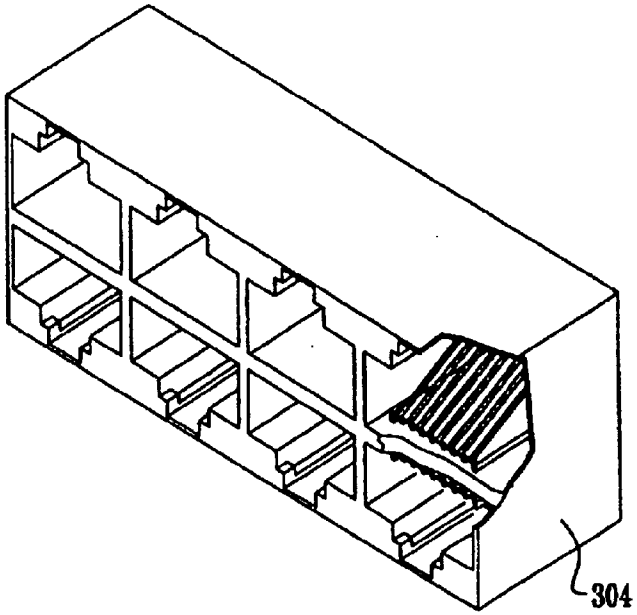
FIGS. 3A and 3B are respective exploded view and assembled pictorial illustrations of an active connector assembly employing the connector elements of FIGS. 1A and 1B, which is constructed and operative in accordance with a preferred embodiment of the present invention.
Figure 3A:
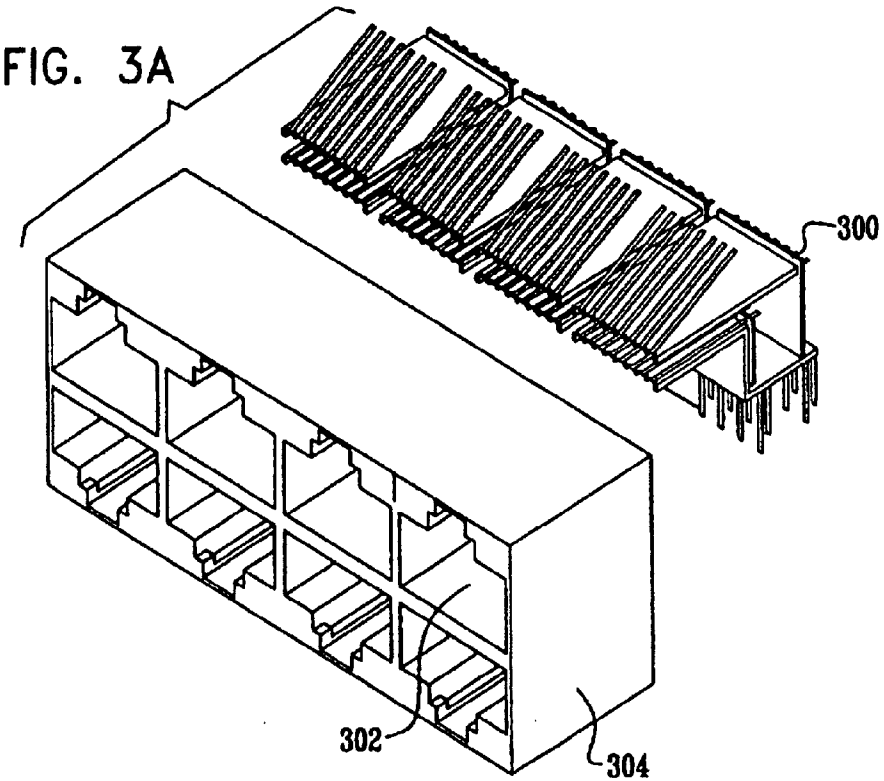

Reference is now made to FIGS. 3A and 3B, which are respective exploded view and assembled pictorial illustrations of an active connector assembly employing the connector elements of FIGS. 1A and 1B, which is constructed and operative in accordance with a preferred embodiment of the present invention. As seen in FIGS. 3A and 3B, a plurality of active connector elements 300, preferably of the type illustrated in FIGS. 1A and 1B, are each retained in a corresponding RJ-45 connector housing portion 302 by any suitable technique, such as the use of interengaging protrusions and sockets. A plurality of connector housing portions 302 are defined, preferably by a unitary RJ-45 ganged connector housing assembly 304.

It will be appreciated that the present invention is not limited to the particular configuration of elements shown in FIGS. 3A and 3B or to any particular configuration of elements whatsoever, but rather extends to any LAN active connector assembly including active electronic circuitry employed for controlling the supply of power over the LAN, whether or not shielding is provided.

Reference is now made to FIGS. 4A–4D, which illustrate four alternative preferred embodiments of active electrical circuitry embodied in the connector elements employed in the connector elements of the embodiments of FIGS. 1A–3B. The embodiments of FIGS. 4A–4D are particularly useful in providing power over LAN functionality for Ethernet local area networks, complying with the IEEE 802.3 standard, and being of the following types: 10baseT; 1000baseT; 1000BaseT.

Figure 4A:
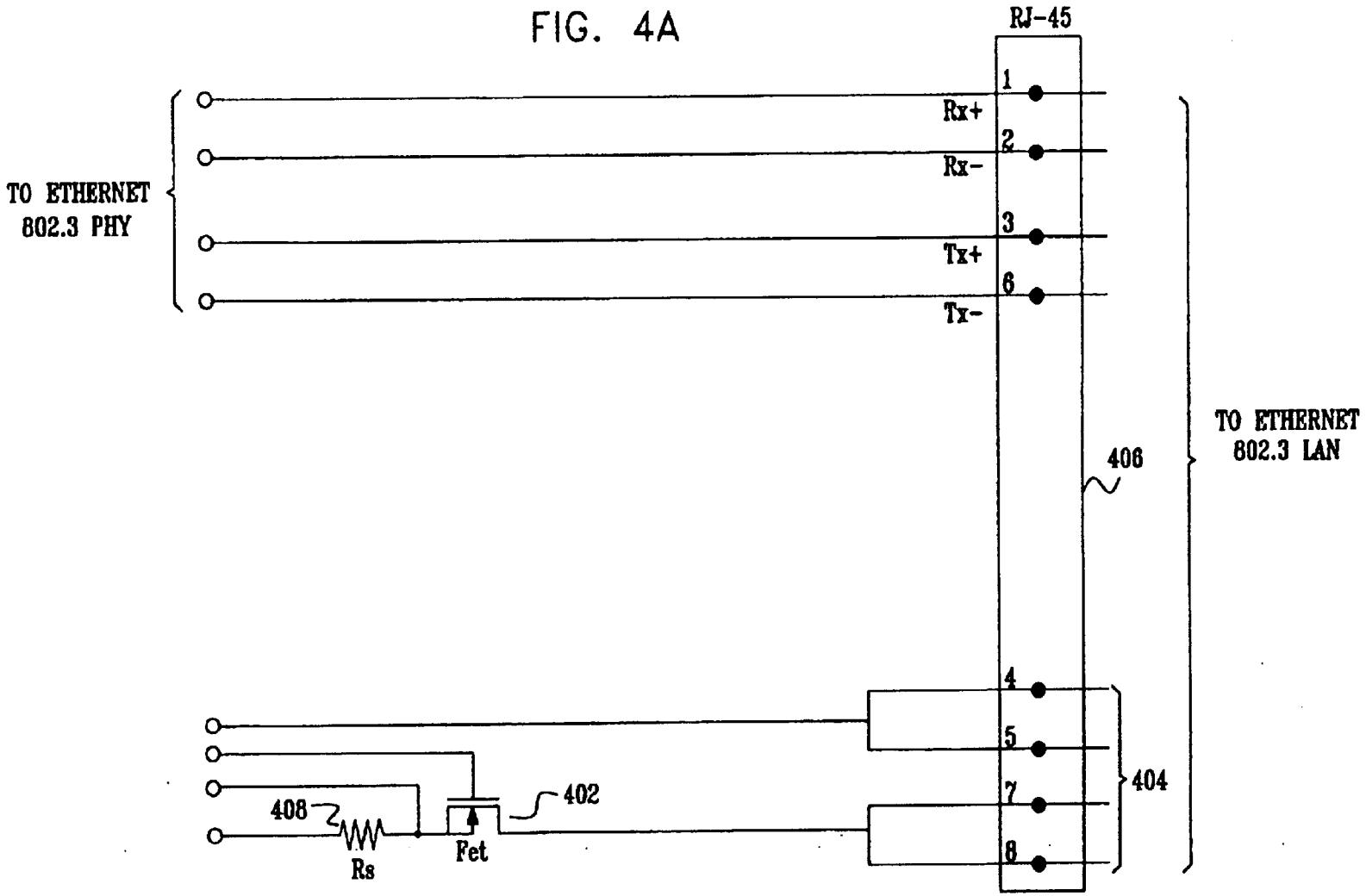
FIGS. 4A, 4B, 4C and 4D are simplified illustrations of four alternative preferred embodiments of active electrical circuitry embodied in the connector elements employed in the connector elements of the embodiments of FIGS. 1A–3B.

The embodiment of FIG. 4A includes a FET control element 402 which is employed as an ON-OFF switch to control the supply of power over spare pairs 404 of an RJ-45 connector 406 used in an Ethernet environment. This embodiment also includes a current sensing resistor 408, which is operative to sense the level of the electrical power supplied over the LAN. It is appreciated that either the FET control element 402 or the resistor 408 may be obviated.

Figure 4B:
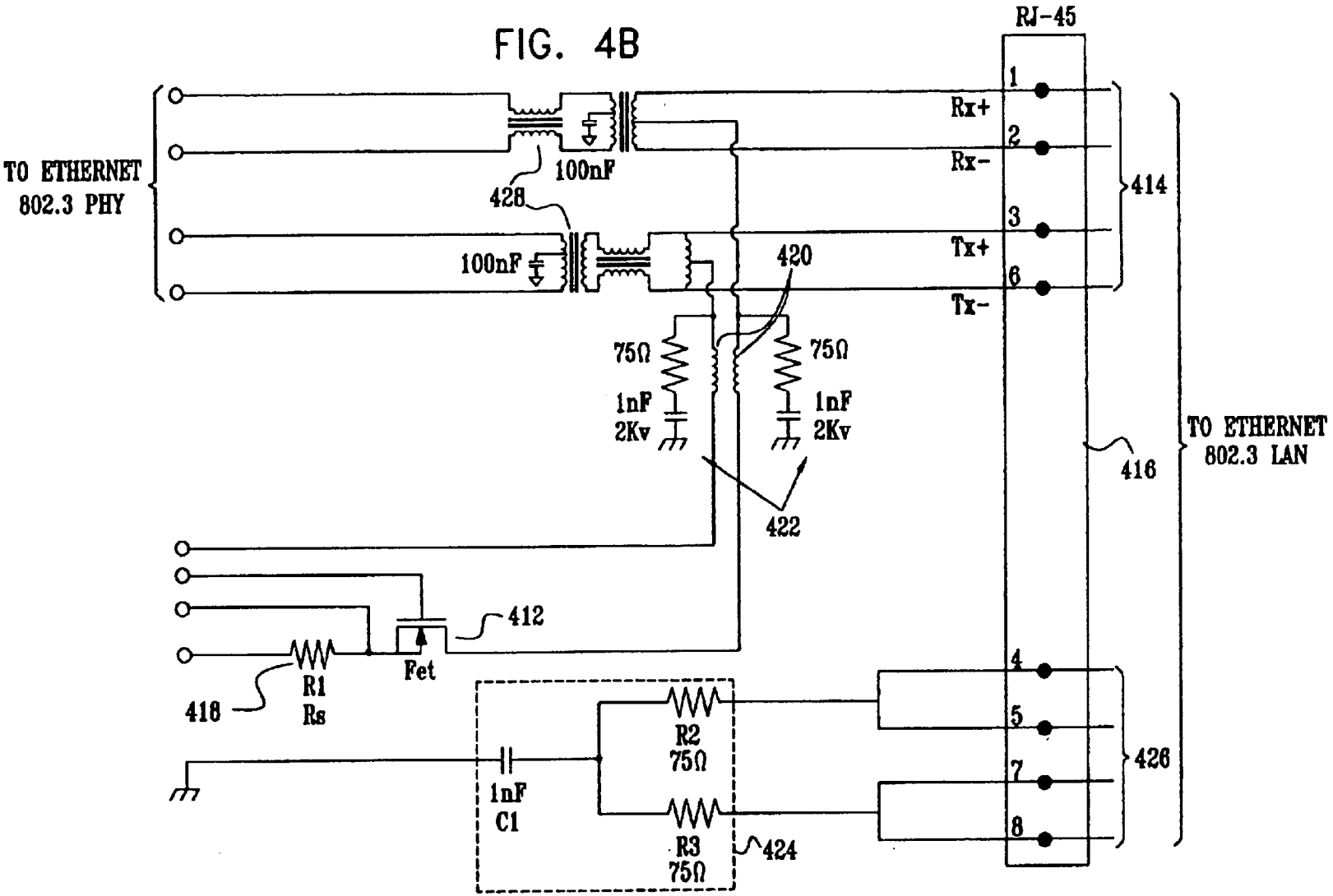

The embodiment of FIG. 4B includes a FET (field effect transistor) control element 412 which is employed as an ON-OFF switch to control the supply of power combined onto and supplied over data pairs 414 of an RJ-45 connector 416 used in an Ethernet environment. This embodiment also includes a current sensing resistor 418, which is operative to sense the level of the electrical power supplied over the LAN. It is appreciated that either the FET control element 412 or the resistor 418 may be obviated.

This embodiment also preferably includes power filtering circuitry 420 and termination circuitry 422 for the data pairs 414 as well as termination circuitry 424 for spare pairs 426.

The embodiment of FIG. 4B includes a FET control element 412 which is employed as an ON-OFF switch to control the supply of power combined onto and supplied over data pairs 414 of an RJ-45 connector 416 used in an Ethernet environment. This embodiment also includes a current sensing resistor 418, which is operative to sense the level of the electrical power supplied over the LAN. It is appreciated that either the FET control element 412 or the resistor 418 may be obviated.

The circuitry may include Ethernet isolation transformers and filters, commonly known as Ethernet magnetics and here designated 428.

FIG. 4B shows two data pairs 414 being used for data communication as in 10baseT and in 100baseT embodiments. However the apparatus of FIG. 4B is also useful in 1000baseT embodiments in which all four data pairs 414 and 426 are used for data communication.

Figure 4C:
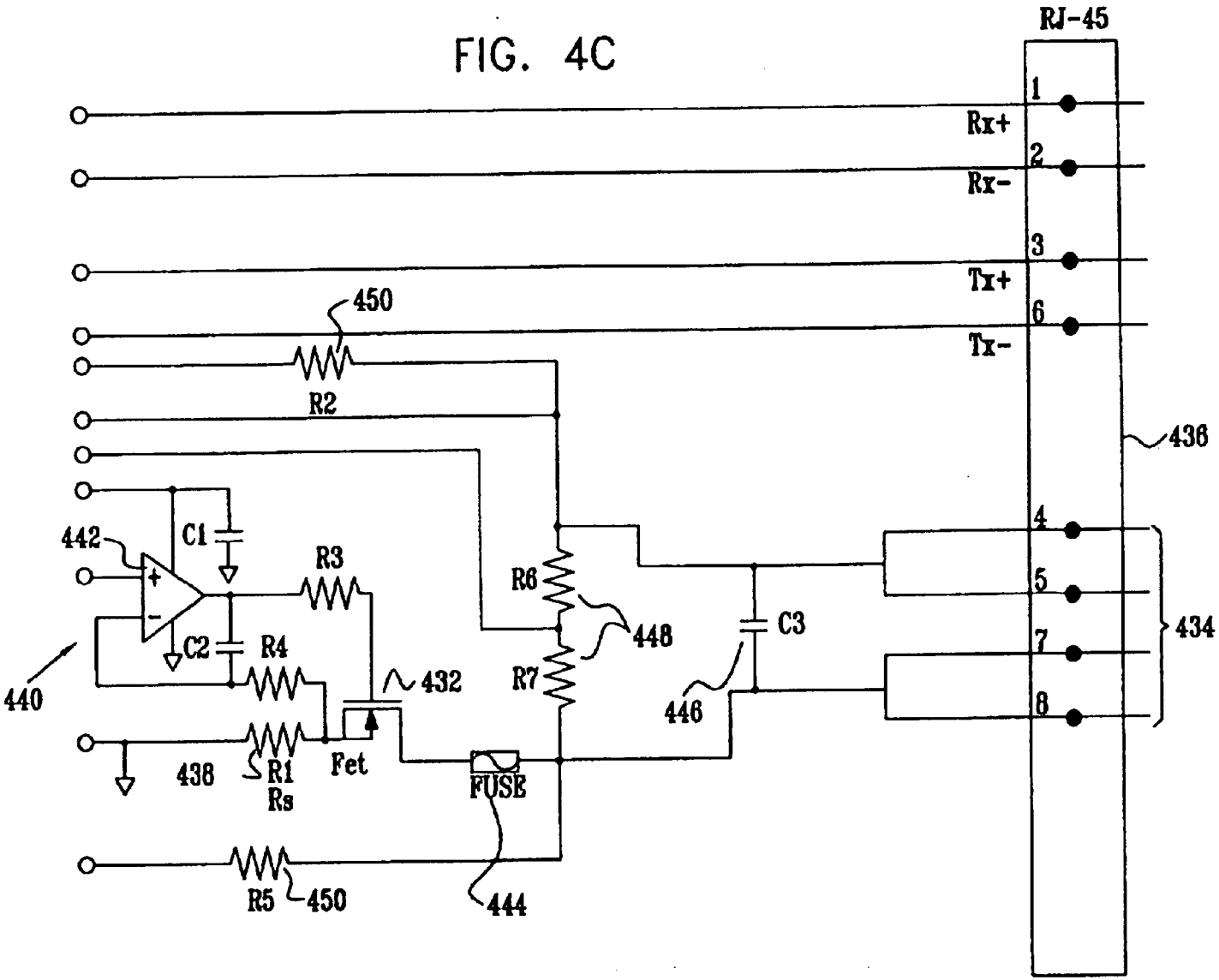

The embodiment of FIG. 4C includes a FET control element 432 which is employed as an ON-OFF switch to control the supply of power over spare pairs 434 of an RJ-45 connector 436 used in an Ethernet environment. This embodiment also includes a current sensing resistor 438, which is operative to sense the level of the electrical power supplied over the LAN. It is appreciated that either the FET control element 432 or the resistor 438 may be obviated.

The embodiment of FIG. 4C also preferably includes control circuitry 440 including an operational amplifier 442 and its associated circuitry, as well as a fuse 444 and an output capacitor 446. This embodiment also includes voltage measuring circuitry, shown as voltage sensing resistors 448, which are operative to sense the voltage of the electrical power supplied over the LAN and also may be employed during line interrogation as defined in the IEEE 802.3af draft standard. Injector resistors 450 may be provided to inject AC (alternating current) pulses on the spare pairs 434 for use in detection of disconnection. It is appreciated that various elements of this circuitry may be obviated.

Figure 4D:
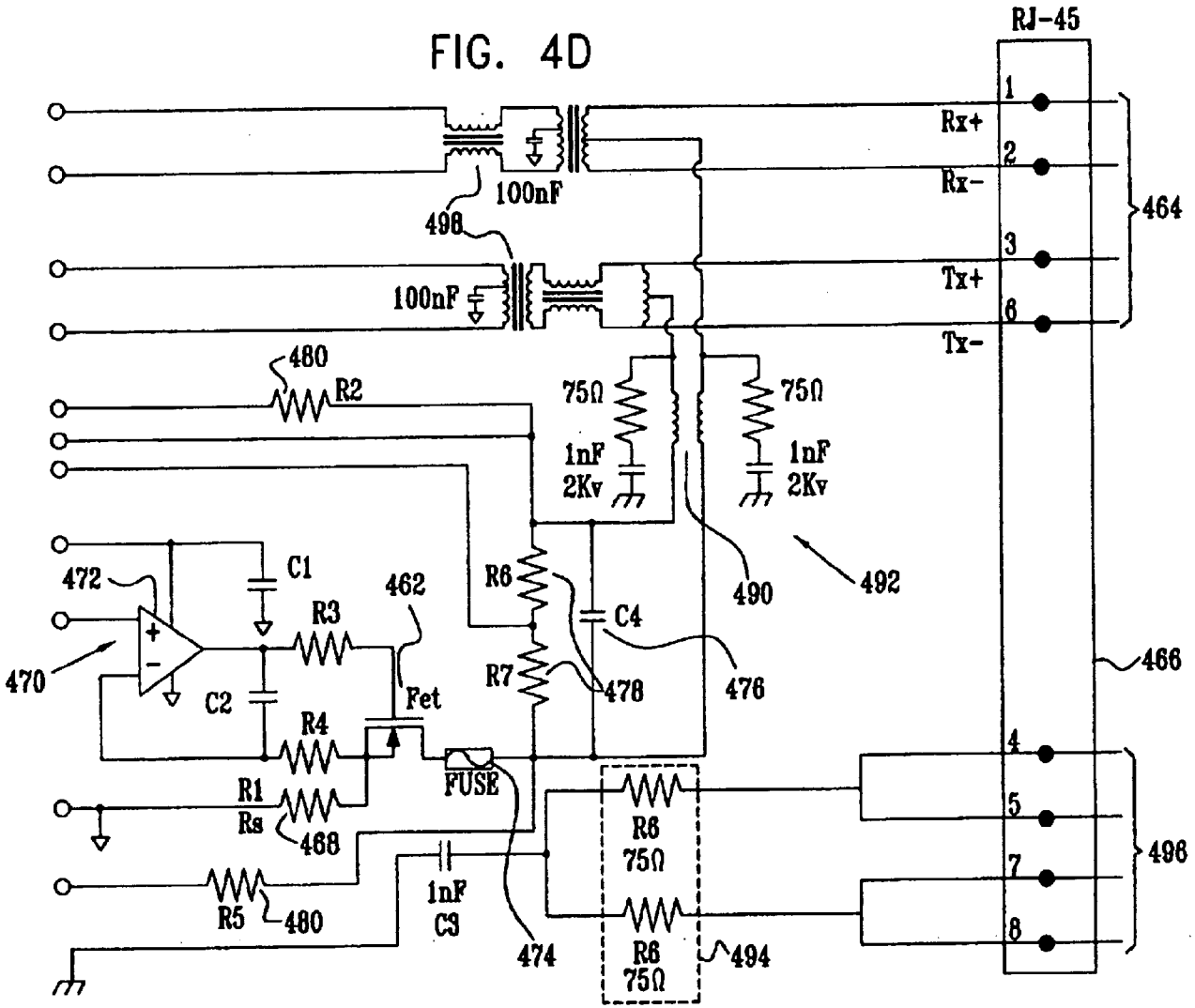

The embodiment of FIG. 4D includes a FET control element 462 which is employed as an ON-OFF switch to control the supply of power combined onto and supplied over data pairs 464 of an RJ-45 connector 466 used in an Ethernet environment. This embodiment also includes a current sensing resistor 468, which is operative to sense the level of the electrical power supplied over the LAN. It is appreciated that either the FET control element 462 or the resistor 468 may be obviated.

The embodiment of FIG. 4D also preferably includes control circuitry 470 including an operational amplifier 472 and its associated circuitry, as well as a fuse 474 and an output capacitor 476. This embodiment also includes voltage measureing circuitry, shown as voltage sensing resistors 478, which are operative to sense the voltage of the electrical power supplied over the LAN and also may be employed during line interrogation as defined in the IEEE 802.3af draft standard. Injector resistors 480 may be provided to inject AC pulses on the spare pairs 496 for use in detection of disconnection. It is appreciated that various elements of this circuitry may be obviated.

This embodiment also preferably includes power filtering circuitry 490 and termination circuitry 492 for the data pairs 464 as well as termination circuitry 494 for spare pairs 496.

The circuitry may include Ethernet isolation transformers and filters, commonly known as Ethernet magnetics and here designated 498.

FIG. 4D shows two data pairs 464 being used for data communication as in 10baseT and in 100baseT embodiments however the apparatus of FIG. 4D is also useful in 1000baseT embodiments in which all four data pairs 464 and 496 are used for data communication.

Figure 5A:
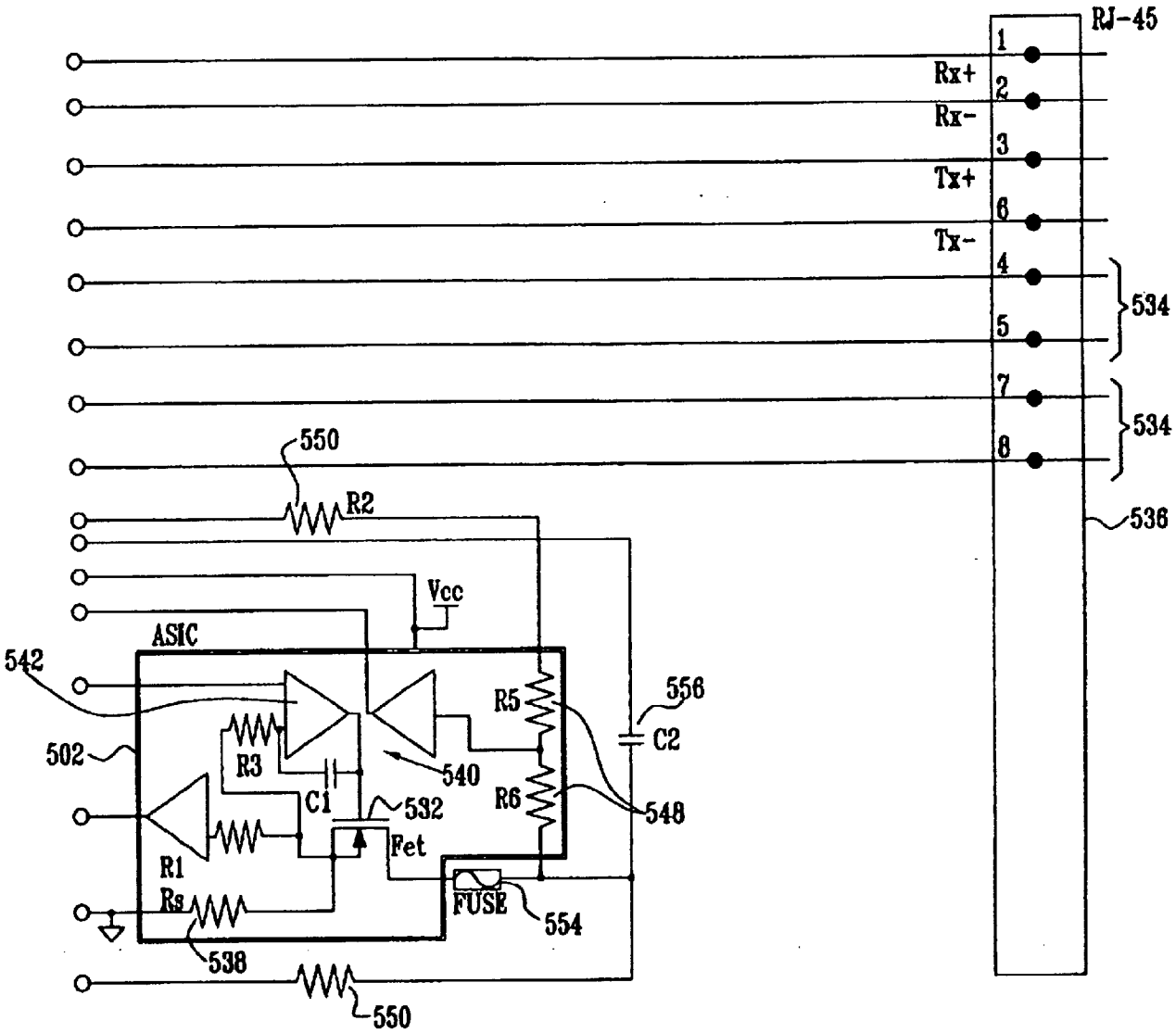
FIGS. 5A and 5B are simplified illustrations of two alternative preferred embodiments of active electrical circuitry embodied in the connector elements employed in the connector elements of the embodiments of FIGS. 1A–3B.
Figure 5B:
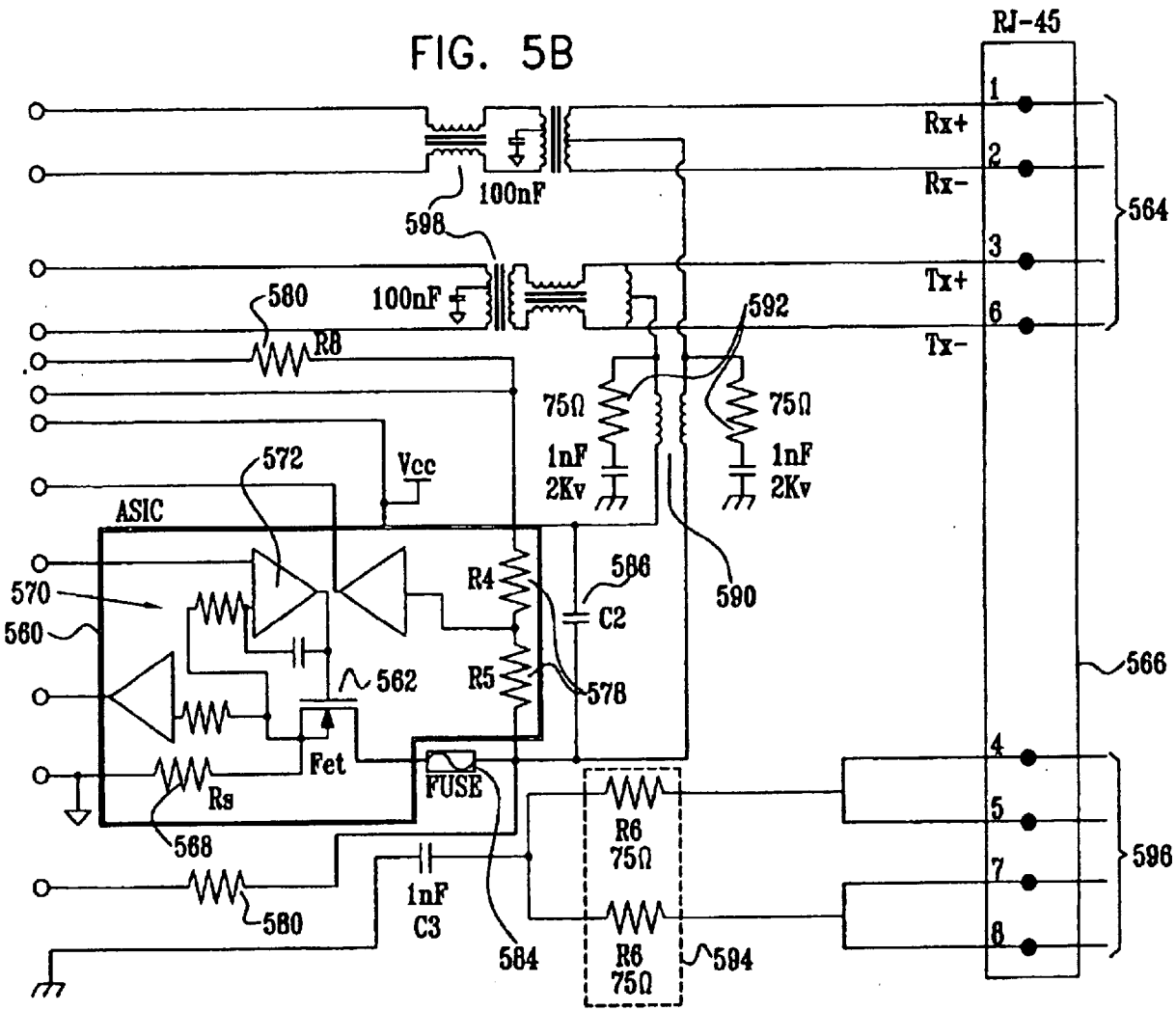

Reference is now made to FIGS. 5A and 5B, which are simplified illustrations of two alternative preferred embodiments of active electrical circuitry embodied in the connector elements employed in the connector elements of the embodiments of FIGS. 1A–3B.

The embodiment of FIG. 5A includes an ASIC 502, which incorporates any one or more of the following functionalities:

a FET control element 532, which is employed as an ON-OFF switch to control the supply of power over spare pairs 534 of an RJ-45 connector 536 used in an Ethernet environment;

a current sensing resistor 538, which is operative to sense the level of the electrical power supplied over the LAN;

control circuitry 540 including an operational amplifier 542 and its associated circuitry; and voltage measuring circuitry, shown as voltage sensing resistors 548, which is operative to sense the voltage of the electrical power supplied over the LAN and also may be employed during line interrogation as defined in the IEEE 802.3af draft standard.

The embodiment of FIG. 5A may also include injector resistors 550 operative to inject AC pulses on the spare pairs 534 for use in detection of disconnection as well as a fuse 554 and an output capacitor 556.

The embodiment of FIG. 5B includes an ASIC 560, which incorporates any one or more of the following functionalities:

a FET control element 562, which is employed as an ON-OFF switch to control the supply of power over data pairs 564 of an RJ-45 connector 566 used in an Ethernet environment;

a current sensing resistor 568, which is operative to sense the level of the electrical power supplied over the LAN;

control circuitry 570 including an operational amplifier 572 and its associated circuitry; and voltage measuring circuitry, shown as voltage sensing resistors 578, which is operative to sense the voltage of the electrical power supplied over the LAN and also may be employed during line interrogation as defined in the IEEE 802.3af draft standard.

The embodiment of FIG. 5B may also include injector resistors 580 may be provided to inject AC pulses on the spare pairs for use in detection of disconnection as well as a fuse 584 and an output capacitor 586.

This embodiment also preferably includes power filtering circuitry 590 and termination circuitry 592 for the data pairs 564 as well as termination circuitry 594 for spare pairs 596.

The circuitry may include Ethernet isolation transformers and filters, commonly known as Ethernet magnetics and here designated 598.

Figure 6A:
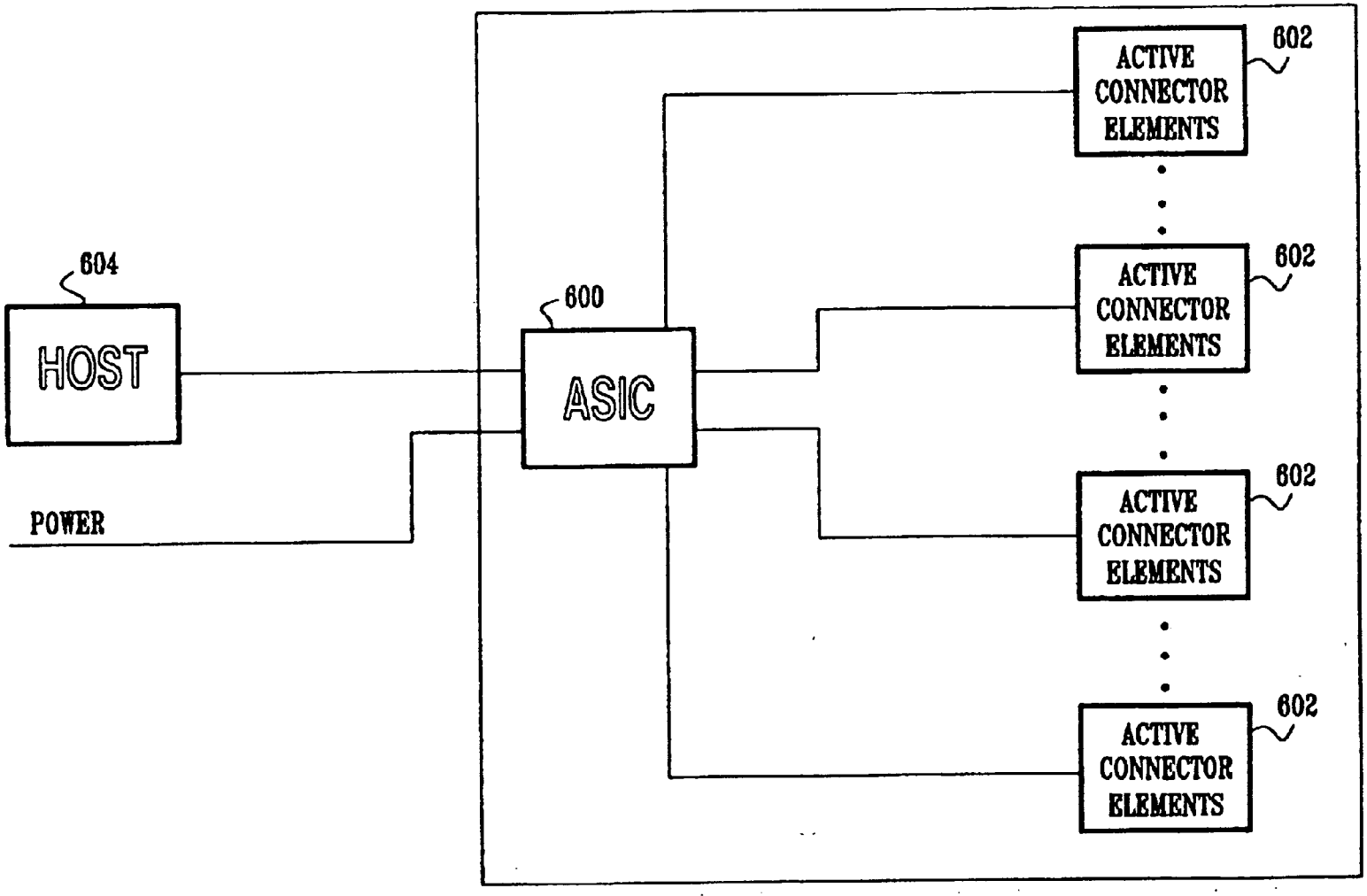
FIG. 6A is a simplified block diagram illustration of connector element circuitry, including an ASIC (application specific integrated circuit), forming part of an active connector constructed and operative in accordance with still another preferred embodiment of the present invention.

FIG. 6A is a simplified block diagram illustration of connector element circuitry, including an ASIC (application specific integrated circuit), forming part of an active connector constructed and operative in accordance with still another preferred embodiment of the present invention.

Figure 6B:
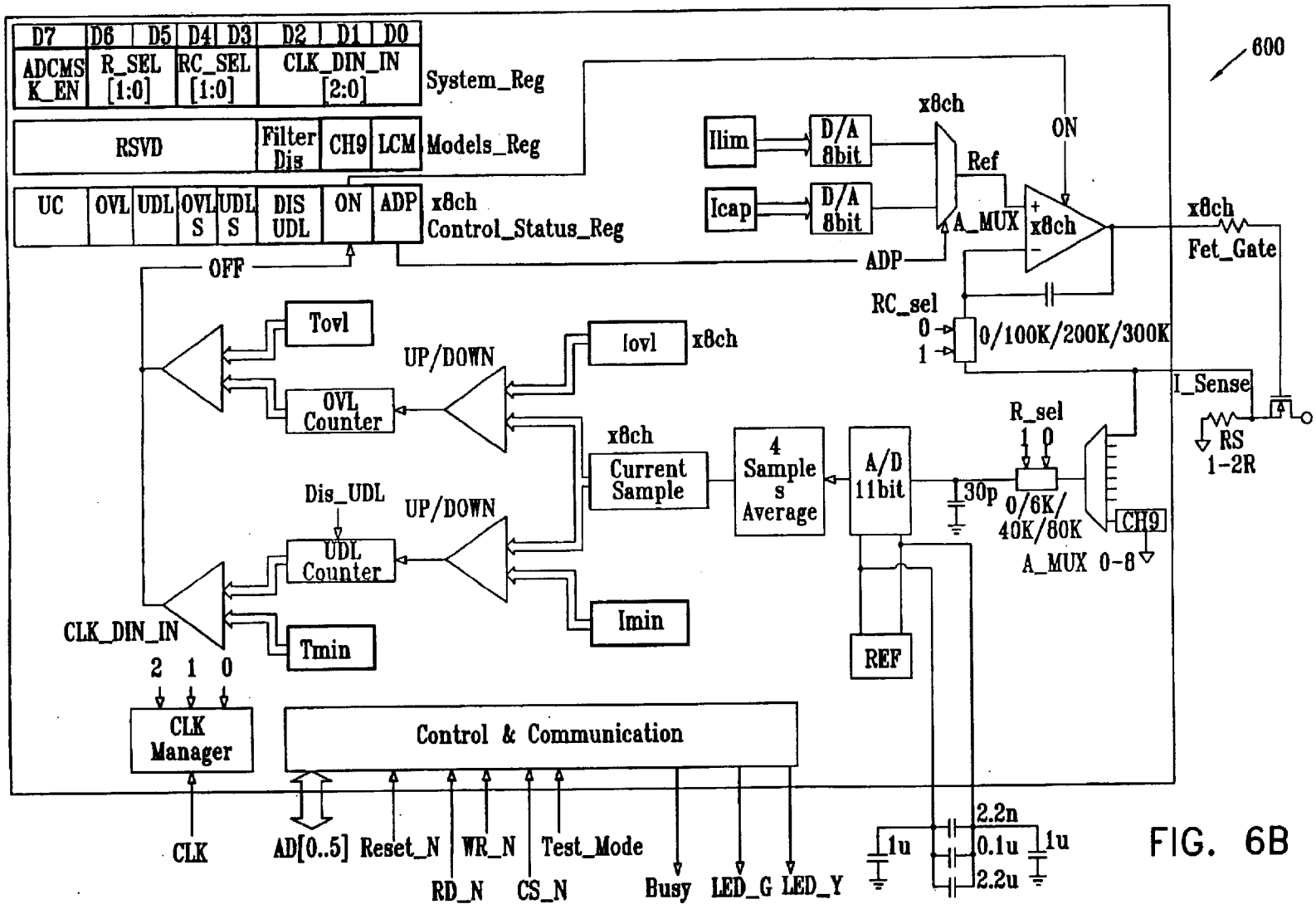
FIG. 6B is a simplified electronic diagram of the ASIC of FIG. 6A constructed and operative in accordance with a preferred embodiment of the present invention.

The circuitry of FIG. 6A includes at least one ASIC 600, whose structure and function is shown in FIG. 6B. The ASIC 600 is connected to a plurality of active connector elements 602, preferably of the type illustrated in FIGS. 1A and 1B, and which may correspond to the circuitry shown in either of FIGS. 4A–4D. Active connector elements 602 are operated by ASIC 600 to provide power over LAN functionality according to the IEEE 802.3af draft standard. ASIC 600 may receive control inputs from and otherwise communicate with a host computer 604.

Figure 7B:
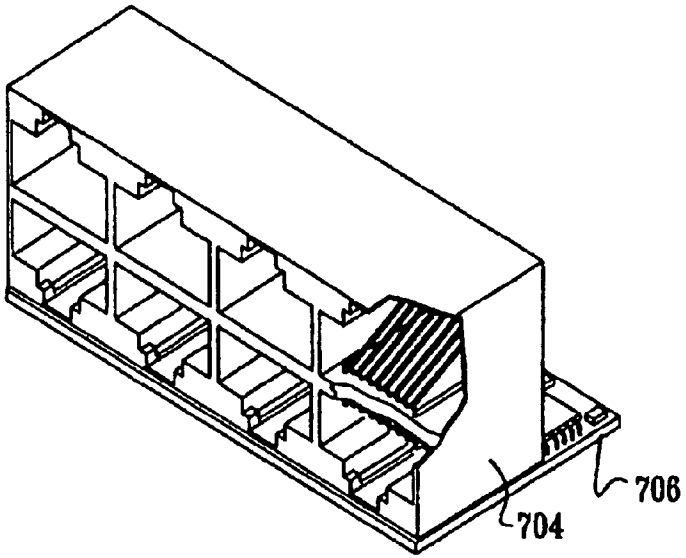
FIGS. 7A and 7B are respective exploded view and assembled pictorial illustrations of an active connector assembly employing the connector elements of FIGS. 6A and 6B, which is constructed and operative in accordance with a preferred embodiment of the present invention.
Figure 7A:
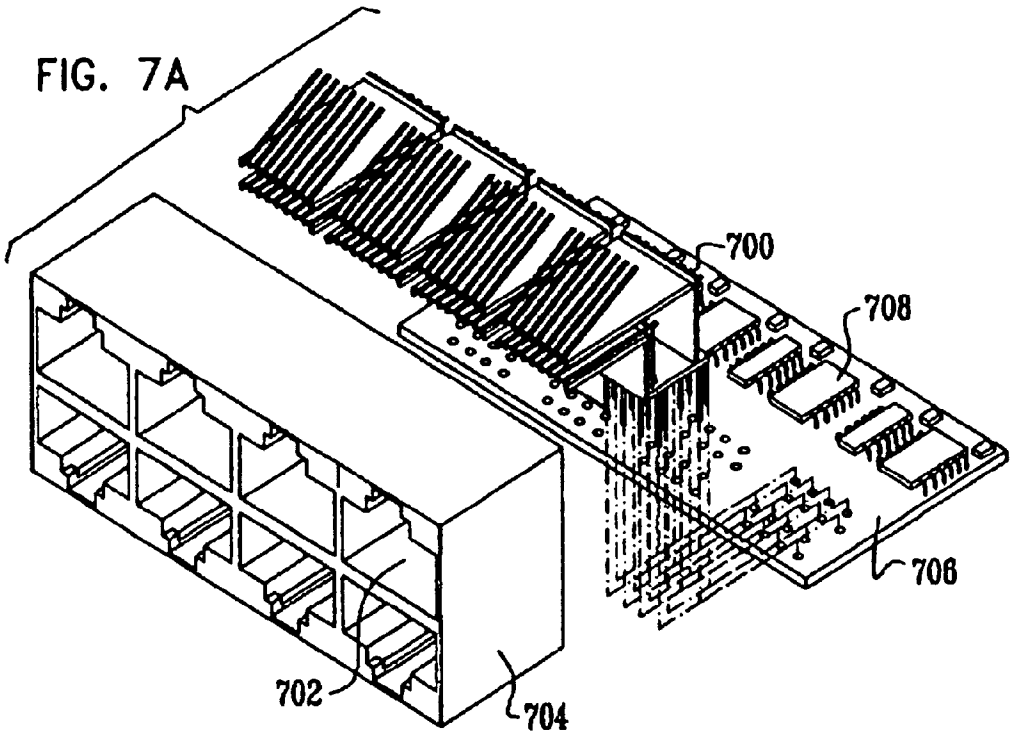

Reference is now made to FIGS. 7A and 7B, which are respective exploded view and assembled pictorial illustrations of an active connector assembly employing the connector elements of FIGS. 1A and 1B and FIGS. 6A and 6B, which is constructed and operative in accordance with a preferred embodiment of the present invention.

As seen in FIGS. 7A and 7B, a plurality of active connector elements 700, preferably of the type illustrated in FIGS. 1A and 1B, are each retained in a corresponding RJ-45 connector housing portion 702 by any suitable technique, such as the use of interengaging protrusions and sockets. A plurality of connector housing portions 702 are defined, preferably by a unitary RJ-45 ganged connector housing assembly 704. In addition, there is disposed within assembly 704 a circuit board 706, which includes an ASIC 708, such as the ASIC 600 shown in FIGS. 6A and 6B and associated circuitry. The ASIC 600 may be packaged in a conventional manner or may be employed in a die form, such as by employing flip chip or die bonding mounting.

It will be appreciated that the present invention is not limited to the particular configuration of elements shown in FIGS. 7A and 7B or to any particular configuration of elements whatsoever, but rather extends to any LAN active connector assembly including active electronic circuitry employed for controlling the supply of power over the LAN, whether or not shielding is provided.

Figure 8A:
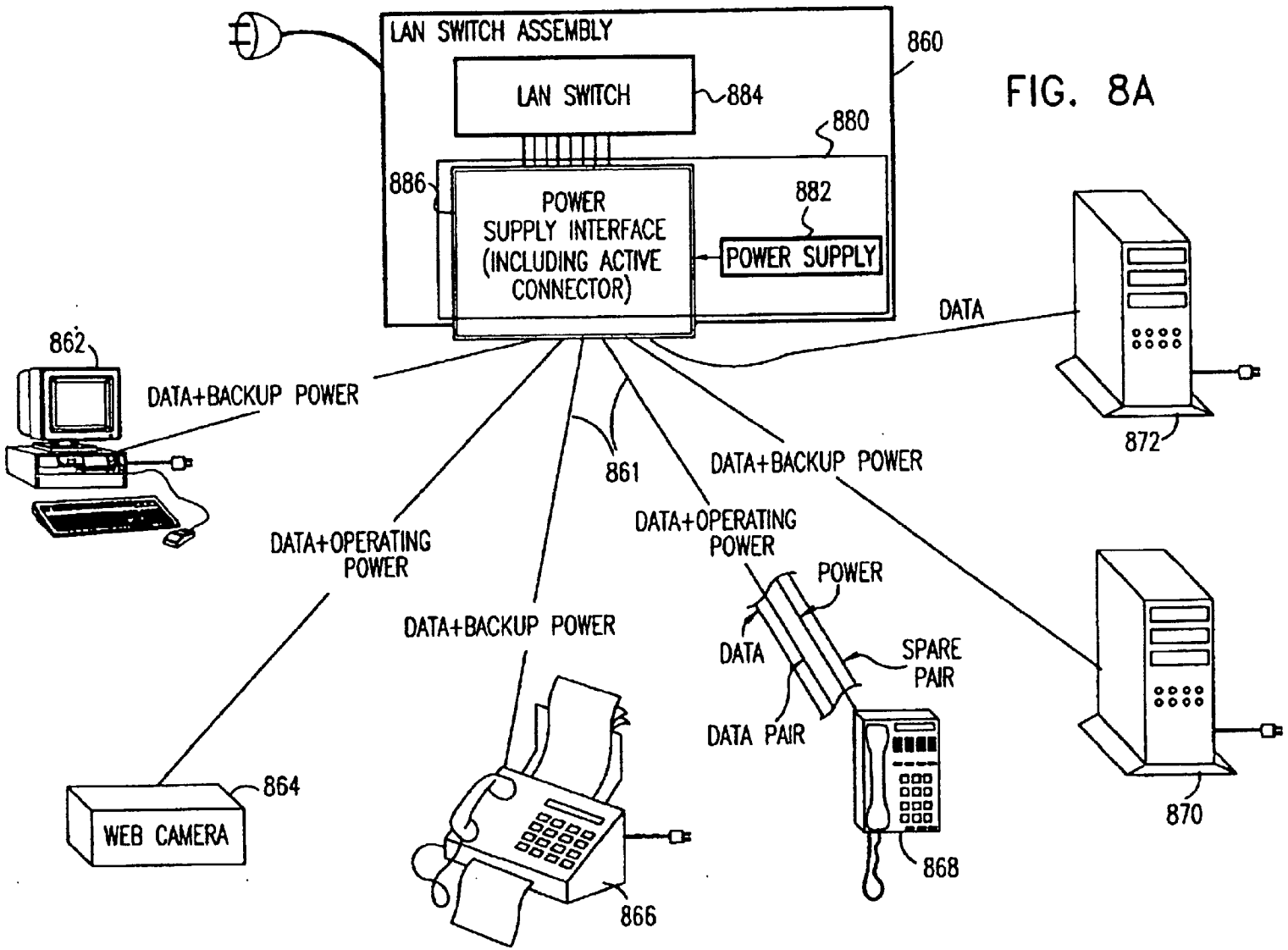
FIG. 8A is a simplified block diagram of a LAN having power over Ethernet functionality, the LAN having a LAN switch assembly which includes an active connector element which may include any one of the active connectors of FIGS. 2A–2B, 3A–3B or 7A–7B.

Reference is now made to FIG. 8A, which is a simplified block diagram illustration of a local area network constructed and operative in accordance with another preferred embodiment of the present invention. As seen in FIG. 8A, there is provided a local area network (LAN) comprising a LAN switch assembly 860 which is coupled to a plurality of LAN nodes, by cabling 861 preferably forming part of a structured cabling system complying with the EIA/TIA 568 and/or ISO/IEC/11801 standards. The plurality of LAN nodes may include any type of LAN node such as, in the illustrated embodiment, a desktop computer 862, a web camera 864, a facsimile machine 866, a LAN telephone, also known as an IP telephone 868, a computer 870 and a server 872. LAN switch assembly 860 complies with the 802.3 Ethernet standard and may employ any suitable LAN protocol such as the 10BaseT protocol, the 100BaseT protocol or the 1000BaseT (gigabit Ethernet) protocol.

Cabling 861 is preferably conventional LAN cabling having four pairs of twisted copper wires cabled together under a common jacket. In the embodiment of FIG. 8A, in contrast to the arrangement described below with respect to FIG. 8B, at least one of the four pairs of twisted copper wires is employed only for transmitting electrical power to nodes of the network and at least one of the pairs of twisted copper wires is employed only for transmitting data. Typically two such pairs are employed for transmitting data only and two such pairs are employed only for supplying electrical power along each line connecting a LAN switch assembly 860 to each node. Alternatively, one or two or more spare pairs are provided (not shown).

In accordance with a preferred embodiment of the present invention there is provided a power supply subsystem 880 which is operative to provide at least some operating or backup power to at least some of said plurality of nodes via the LAN switch assembly 860 and the communication cabling 861 connecting the LAN switch assembly 860 to various LAN nodes.

In the illustrated embodiment of FIG. 8A, power-over-Ethernet subsystem 880 is located within the LAN switch assembly 860 and includes a power supply 882 which supplies operating power and/or backup power to various LAN nodes via the communication cabling 861. The communication cabling 861 connects a LAN switch 884 via a power supply interface 886 to the various LAN nodes. The power supply interface 886 distributes electrical power from the power supply 882, along twisted pairs of the communication cabling 861, which are not used for carrying data, to at least some of the LAN nodes. Bidirectional data communications from LAN switch 884 pass through the power supply interface 886, substantially without interference.

It is seen that the communication cabling 861 from the LAN switch assembly 860 to the desktop computer 862, facsimile machine 866 and computer 870 carries both data and backup power along separate twisted pairs, while the communication cabling 861 from the LAN switch assembly 860 to the web camera 864 and LAN telephone 868 carries both data and operating power along separate twisted pairs and the communication cabling 861 from the LAN switch assembly 860 to the server 872 carries only data, in a typically LAN arrangement constructed and operative in accordance with a preferred embodiment of the present invention.

It is a particular feature of a preferred implementation of the embodiment of FIG. 8A that data and power are carried on separate twisted copper pairs of each communication cabling line.

It is appreciated that each of the LAN nodes 862–870 which receives power over the communication cabling 861 includes a connector for connecting the twisted pairs carrying electrical power to the power supply 882 and separately connecting the twisted pairs carrying data to a data input of the node. In the illustrated embodiment of FIG. 8A, the connectors are typically internal to the respective nodes and are not separately designated, it being appreciated that alternatively discrete connectors may be employed.

Figure 8B:
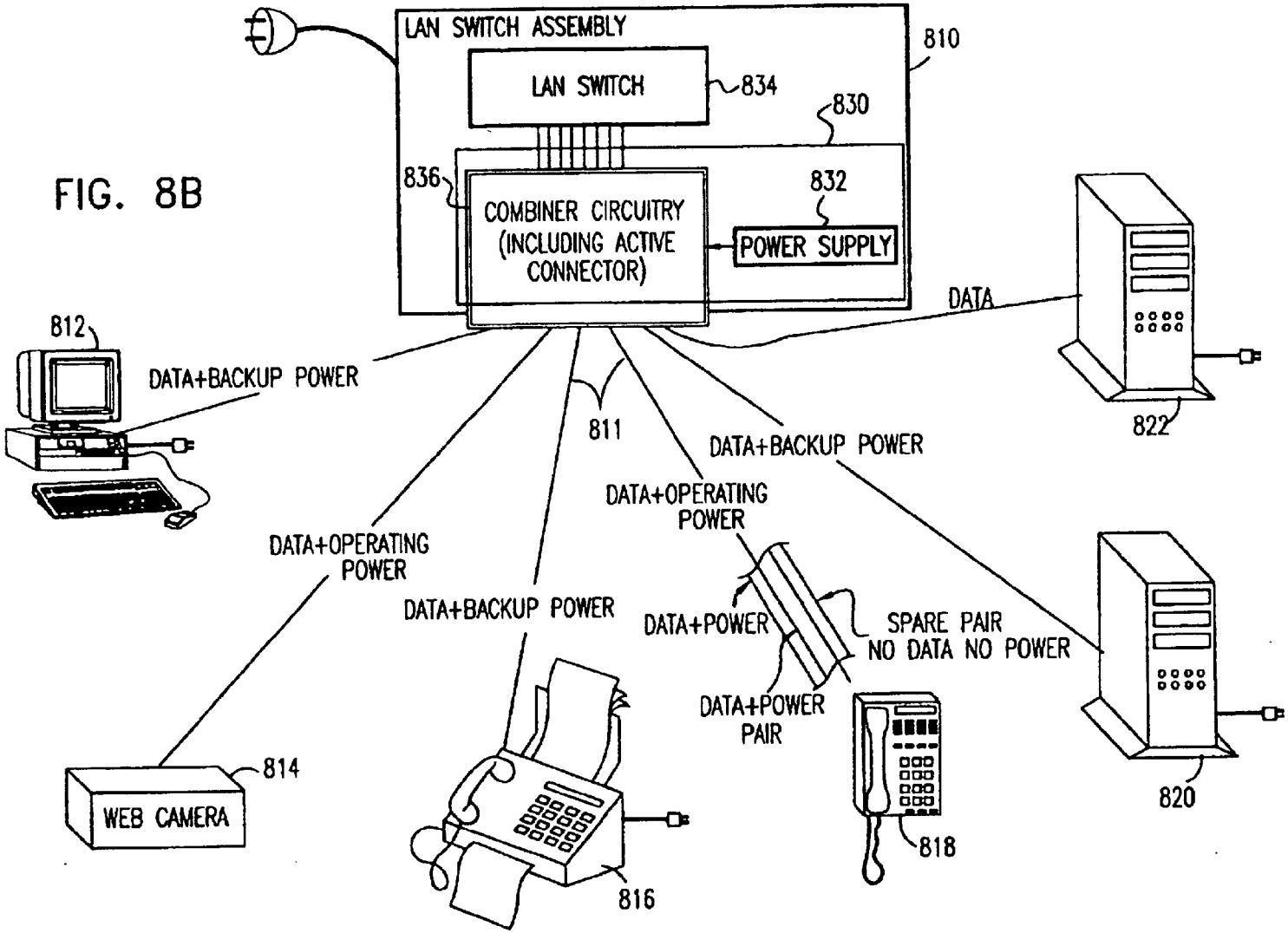
FIG. 8B is a simplified block diagram of a LAN similar to the LAN of FIG. 8A except that in the embodiment of FIG. 8B, power is fed over wire pairs additionally used for data communication rather than over dedicated power pairs.

Reference is now made to FIG. 8B, which is a simplified block diagram illustration of a local area network constructed and operative in accordance with a preferred embodiment of the present invention. As seen in FIG. 8B, there is provided a local area network (LAN) comprising a LAN switch assembly 810 which is coupled to a plurality of LAN nodes, by cabling 811 preferably forming part of a structured cabling system complying with the EIA/TIA 568 and/or ISO/IEC/11801 standards. The plurality of LAN nodes may include any type of LAN node such as, in the illustrated embodiment, a desktop computer 812, a web camera 814, a facsimile machine 816, a LAN telephone, also known as an IP telephone 818, a computer 820 and a server 822. LAN switch assembly 810 complies with the 802.3 Ethernet standard and may employ any suitable LAN protocol such as the 10BaseT protocol, the 100BaseT protocol or the 1000BaseT (gigabit Ethernet) protocol.

Cabling 811 is preferably conventional LAN cabling having four pairs of twisted copper wires cabled together under a common jacket. In the embodiment of FIG. 8B, as will be described hereinbelow, at least one of the pairs of twisted copper wires is employed for transmitting both data and electrical power to nodes of the network. Typically two such pairs are employed for transmitting both data and electrical power along each line connecting a LAN switch assembly to each node, while one such pair carries data only and a fourth pair is maintained as a spare and carries neither data nor power.

In accordance with a preferred embodiment of the present invention there is provided a power supply subsystem 832 which is operative to provide at least some operating or backup power to at least some of said plurality of nodes via the LAN switch assembly 810 and the communication cabling 811 connecting the LAN switch assembly 810 to various LAN nodes.

In the illustrated embodiment of FIG. 8B, power-over-Ethernet subsystem 830 is located within the LAN switch assembly 810 and includes a power supply 832 which supplies operating power and/or backup power to various LAN nodes via the communication cabling 811. The communication cabling 811 connects a LAN switch 834 via a combiner 836 to the various LAN nodes. The combiner 836 couples and combines electrical power from the power supply 832 to at least some of the wires carrying data along the communication cabling 811 to at least some of the LAN nodes. Bidirectional data communications from LAN switch 834 pass through the combiner 836, substantially without interference.

It is a particular feature of a preferred embodiment of the present invention that the circuitry of combiner 836 comprises an active connector which may be based on the connector elements of FIGS. 1A–1B, 3A–3B and 7A–7B.

It is seen that the communication cabling 811 from the LAN switch assembly 810 to the desktop computer 812, facsimile machine 816 and computer 820 carries both data and backup power, while the communication cabling from the LAN switch assembly 810 to the web camera 814 and LAN telephone 818 carries both data and operating power and the communication cabling from the LAN switch assembly 810 to the server 822 carries only data, in a typically LAN arrangement constructed and operative in accordance with a preferred embodiment of the present invention.

It is a particular feature of a preferred implementation of the embodiment of FIG. 8B, that both data and power are carried on the same twisted copper pair so as to comply with the 802.3af draft standard.

It is appreciated that each of the LAN nodes 812–820, which receives power over the communication cabling, includes a separator for separating the electrical power from the data. In the illustrated embodiment of FIG. 8B, the separators are typically internal to the respective nodes and are not separately designated, it being appreciated that alternatively discrete separators may be employed.

Figure 9A:
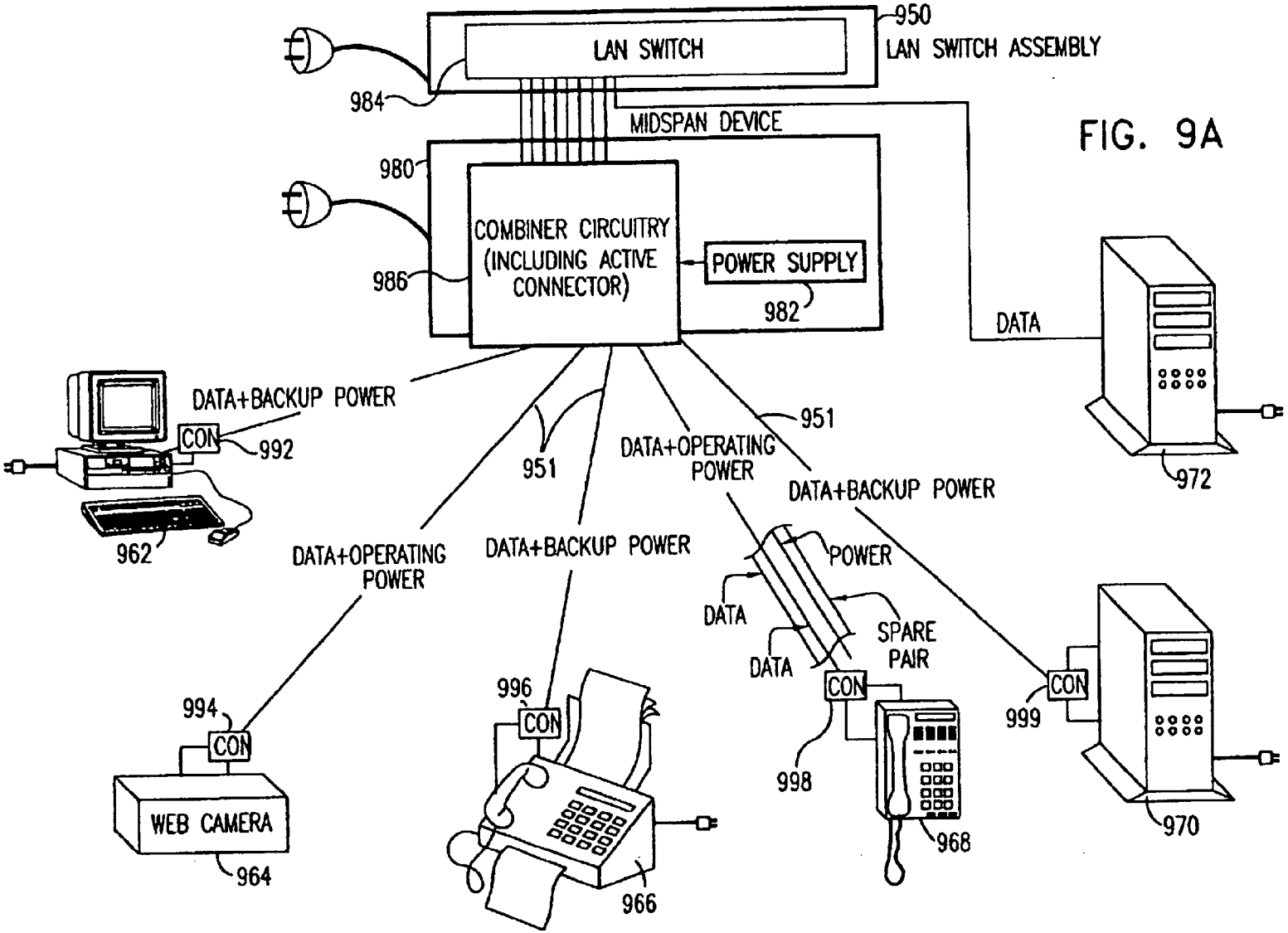
FIG. 9A is a simplified block diagram of a LAN having power over Ethernet functionality the LAN having a mid-span device assembly which includes an active connector element which may include any one of the active connectors of FIGS. 2A–2B, 3A–3B or 7A–7B.
Figure 9B:
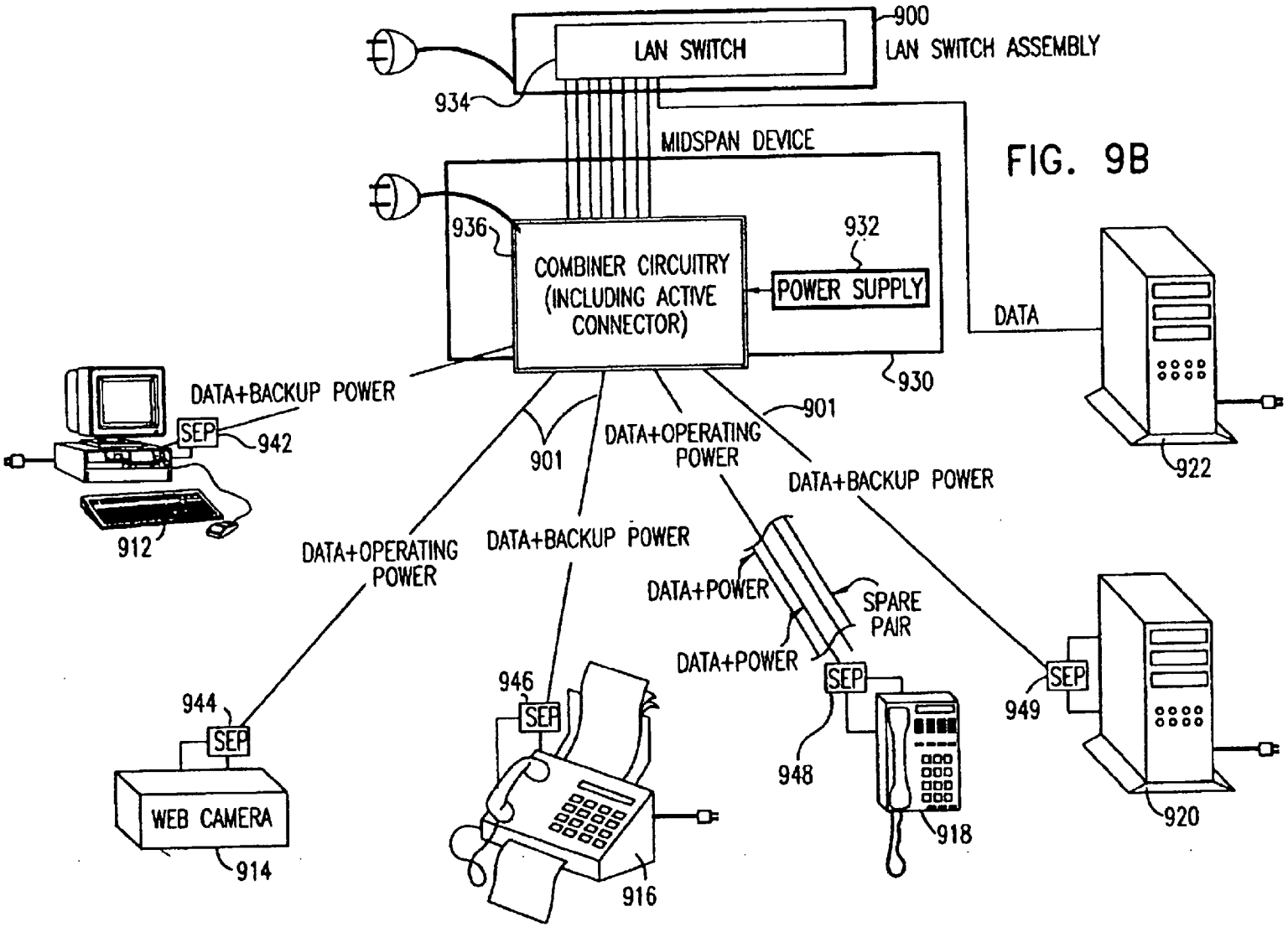
FIG. 9B is a simplified block diagram of a LAN similar to the LAN of FIG. 9A except that in the embodiment of FIG. 9B, power is fed over wire pairs additionally used for data communication rather than over dedicated power pairs.

It is appreciated that FIGS. 8A and 8B illustrate two embodiments of a system providing electric power to plural LAN nodes via a LAN switch assembly 810 and communication cabling 811 connecting the LAN switch assembly 810 to various LAN nodes. Another two embodiments of a system providing electric power to plural LAN nodes via a LAN switch assembly and communication cabling connecting the LAN switch assembly to various LAN nodes are illustrated in FIGS. 9A and 9B. FIGS. 9A and 9B illustrate a local area network including a power supply operative to provide electrical power to local area network nodes over communication cabling.

In the illustrated embodiment of FIG. 9A, a conventional LAN switch assembly 950 does not provide electrical power over the communication cabling 951; A midspan device 980 is located externally of LAN switch assembly 950 and includes a power supply 982, which supplies operating power and/or backup power to various LAN nodes via the communication cabling 951. The midspan device 980 is coupled to a plurality of LAN nodes, by cabling 951 preferably forming part of a structured cabling system complying with the EIA/TIA 568 and/or ISO/IEC/11801 standards. The communication cabling 951 connects a LAN switch 984 of conventional LAN switch assembly 950 to a combiner 986 in midspan device 980 and connects the combiner 986 to the various LAN nodes.

It is a particular feature of a preferred embodiment of the present invention that the circuitry of combiner 986 comprises an active connector which may be based on the connector elements of FIGS. 1A–1B, 3A–3B and 7A–7B.

The combiner distributes electrical power from the power supply 982 along the communication cabling 951 to at least some of the LAN nodes. Bidirectional data communications from LAN switch 984 pass through the combiner 986, substantially without interference.

LAN switch assembly 950 complies with the 802.3 Ethernet standard and may employ any suitable LAN protocol such as the 10BaseT protocol, the 100BaseT protocol or the 1000BaseT (gigabit Ethernet) protocol.

Cabling 951 is preferably conventional LAN cabling having four pairs of twisted copper wires cabled together under a common jacket. In the embodiment of FIG. 9A, in contrast to the arrangement described below with respect to FIG. 9B, at least one of the pairs of twisted copper wires is employed only for transmitting electrical power to nodes of the network and at least one of the pairs of twisted copper wires is employed only for transmitting data. Typically two such pairs are employed for transmitting data only and two such pairs are employed only for supplying electrical power along each line connecting a LAN switch assembly to each node.

It is seen that the communication cabling 951 from the LAN switch assembly 950 to a desktop computer 962, facsimile machine 966 and computer 970 carries both data and backup power. In contrast, the communication cabling from the LAN switch assembly 950 to the web camera 964 and LAN telephone 968 carries both data and operating power. The communication cabling from the LAN switch assembly 950 to the server 972 carries only data and may, but need not, pass through midspan device 980, in a typical LAN arrangement constructed and operative in accordance with a preferred embodiment of the present invention.

It is a particular feature of a preferred implementation of the embodiment of FIG. 9A that data and power are carried on separate twisted copper pairs of each communication cabling line.

In the illustrated embodiment of FIG. 9A, each of the LAN nodes 962–970 which receives power is provided with an external connector for separately providing data and electrical power from the communication cabling. The external connector associated with respective nodes 962–970 are designated by respective reference numbers 992–999. Each such connector has a communication cabling input and separate data and power outputs. It is appreciated that some or all of the nodes 962–970 may alternatively be provided with internal connectors and that some or all of the nodes 962–970 may be provided with external connectors.

In the illustrated embodiment of FIG. 9B, a conventional LAN switch assembly 900 does not provide electrical power over the communication cabling 901. A midspan device 930 is located externally of LAN switch assembly 900 and includes a power supply 932 which supplies operating power and/or backup power to various LAN nodes via the communication cabling 901. The midspan device 930 is coupled to a plurality of LAN nodes, by cabling 901 preferably forming part of a structured cabling system complying with the EIA/TIA 568 and/or ISO/IEC/11801 standards.

The communication cabling connects a LAN switch 934 of conventional LAN switch assembly 900 to a combiner 936 in midspan device 930 and connects the combiner 936 to the various LAN nodes. The combiner 936 provides electrical power from the power supply 932 and combines electrical power along at least some of the wires carrying data of the communication cabling 901 for delivery of combined power and data to at least some of the LAN nodes. Bidirectional data communications from LAN switch 934 pass through the combiner 936, substantially without interference.

It is a particular feature of a preferred embodiment of the present invention that the circuitry of combiner 936 comprises an active connector which may be based on the connector elements of FIGS. 1A–1B, 3A–3B and 7A–7B.

LAN switch assembly 900 complies with the 802.3 Ethernet standard and may employ any suitable LAN protocol such as the 10BaseT protocol, the 100BaseT protocol or the 1000BaseT (gigabit Ethernet) protocol.

Cabling 901 is preferably conventional LAN cabling having four pairs of twisted copper wires cabled together under a common jacket. In the embodiment of FIG. 9B, as will be described hereinbelow, at least one of the pairs of twisted copper wires is employed for transmitting both data and electrical power to nodes of the network. Typically two such pairs are employed for transmitting both data and electrical power along each line connecting the midspan device 930 to each node, while one such pair carries data only and a fourth pair is maintained as a spare and carries neither data nor power.

It is seen that the communication cabling 901 from the midspan device 930 to the desktop computer 912, facsimile machine 916 and computer 920 carries both data and backup power, while the communication cabling from the midspan device 930 to the web camera 914 and LAN telephone 918 carries both data and operating power and the communication cabling from the LAN switch assembly 900 to the server 922 carries only data and may, but need not pass through midspan device 930, in a typically LAN arrangement constructed and operative in accordance with a preferred embodiment of the present invention.

It is a particular feature of a preferred implementation of the embodiment of FIG. 9B that both data and power are carried on the same twisted copper pair so as to comply with the 802.3af draft standard.

In the illustrated embodiment of FIG. 9B, each of the LAN nodes 912–920 which receives power is provided with an external separator for separating the data from the electrical power coupled to the communication cabling. The external separators associated with respective nodes 912–920 are designated by respective reference numbers 942–949. Each such separator has a communication cabling input and separate data and power outputs. It is appreciated that some or all of the nodes 912–920 may alternatively be provided with internal separators and that some or all of the nodes 912–920 may be provided with external separators.

It is appreciated that the applicability of the present invention is not limited to the LAN nodes specifically described hereinabove in FIGS. 8A–9B. The present invention is additionally useful with other suitable nodes such as, for example, wireless LAN access points, emergency lighting system elements, paging loudspeakers, CCTV cameras, alarm sensors, door entry sensors, access control units, laptop computers, network elements, such as hubs, switches and routers, monitors and memory backup units for PCs and workstations.

It is appreciated that the software components of the present invention may, if desired, be implemented in ROM (read-only memory) form. The software components may, generally, be implemented in hardware, if desired, using conventional techniques.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

What is claimed is:

1. An active local area network connector assembly comprising:

an active connector housing for use with local area network (LAN) equipment;

first electrical contacts mounted in said housing and arranged for detachable connection with corresponding electrical contacts of at least one plugs, said first electrical contacts comprising at least one data pair for transmitting power and data between said local area network equipment and at least one LAN node;

second electrical contacts arranged for connection with said local area network equipment, said second electrical contacts carrying electrical power for said at least one LAN node; and active power circuitry coupled to at least one of said at least one data pair and at least one of said second electrical contacts, said active power circuitry comprising voltage measuring circuitry, said voltage measuring circuitry being employable for line interrogation.

2. An active local area network connector according to claim 1, wherein said voltage measuring circuitry comprises at least one voltage sensing resistor.

3. An active local area network connector according to claim 1, wherein said active power circuitry is operative to control said electrical power for said at least one LAN node responsive to said line interrogation.

4. An active local area network connector according to claim 3, wherein said active power circuitry comprises at least one of the following types of circuitry operative to control said electrical power:

application specific integrated circuitry (ASIC);

FET circuitry;

current sensing circuitry;

current limiting circuitry; and

AC disconnecting circuitry.

5. An active local area network connector according to claim 3, wherein said at least one LAN node comprises multiple LAN nodes and wherein said active power circuitry is operative to simultaneously control power for said multiple LAN nodes.

6. An active local area network connector according to claim 1, further comprising third electrical contacts arranged for connection with electrical contacts of said local area network equipment, said third electrical contacts carrying data for said at least one data pair and being in data communication with said at least one data pair.

7. An active local area network connector according to claim 6, wherein said active power circuitry combines said power carried by said second electrical contacts with said data carried by said third electrical contacts for connection to said at least one data pair thereby transmitting power and data over said at least one data pair without substantially interfering with said data.

8. An active connector according to claim 1, further comprising at least one socket arranged for selectably retaining said at least one plugs in electrical contact with said first plurality of first electrical contacts.

9. An active local area connector according to claim 1, further comprising at least one RJ-45 socket arranged for selectably retaining at least one RJ-45 plug in electrical contact with said first electrical contacts, said at least one plugs being said RJ-45 plug.

10. An active local area network connector according to claim 1, further comprising at least one RJ-21 socket arranged for selectably retaining at least one RJ-21 plug in electrical contact with said first plurality of first electrical contacts, said at least one plugs being said RJ-21 plug.

11. An active local area connector according to claim 1, wherein said first electrical contacts are one of RJ-45 compatible and RJ-21 compatible.

12. An active local area connector according to claim 1, wherein the active local area network connector is Ethernet compatible.

13. An active local area network connector according to claim 1, wherein said local area network equipment comprises a switch with integral power over LAN functionality.

14. An active local area network connector according to claim 13, wherein said power over LAN functionality is according to IEEE 802.3af.

15. An active local area network connector according to claim 14, wherein the active local area network connector complies with the IEEE 802.3 standard.

16. An active local area network connector according to claim 14, wherein said Ethernet compatible active local area network connector supports one of the following:

a 10baseT communication protocol;

a 100baseT communication protocol; and a 1000baseT communication protocol.

17. An active local area network connector according to claim 1, wherein said local area network equipment comprises a midspan device with integral power over LAN functionality.

18. An active local area network connector according to claim 17, wherein said power over LAN functionality is according to IEEE 802.3af.

19. An active local area network connector according to claim 18, wherein said Ethernet compatible active local area network connector supports one of the following:

a 10baseT communication protocol;

a 100baseT communication protocol; and a 1000baseT communication protocol.

20. Au active local area network connector according to claim 1, wherein said first electrical contacts comprise a plurality of data pairs.

21. An active local area network connector according to claim 1, wherein said active connector housing and said active power circuitry form the connector housing assembly.

22. An active local area network connector according to claim 1, wherein said active power circuitry is disposed on a circuit board, said circuit board and said active connector housing form the connector housing assembly.

23. An active RJ-45 compatible connector assembly comprising:

an RJ-45 compatible connector housing for use with local area network (LAN) equipment;

first electrical contacts mounted in said RJ-45 compatible connector housing and arranged for detachable connection with corresponding electrical contacts of at least one plugs, said first electrical contacts comprising at least one data pair for transmitting power and data between said local area network equipment and at least one LAN node;

second electrical contacts for connection with said local area network equipment, said second electrical contacts carrying electrical power for said at least one LAIN node; and active power circuitry coupled to at least one of said at least one data pair and at least one of said second electrical contacts, said active power circuitry comprising voltage measuring circuitry, said voltage measuring circuitry being employable for line interrogation.

24. An active RJ-45 compatible connector housing assembly according to claim 23, wherein said active power circuitry is disposed on a circuit board.

25. An active RJ-45 compatible connector assembly comprising: an RJ-45 compatible connector housing for use with local area network (LAN) equipment;

first electrical contacts mounted in said RJ-45 compatible connector housing and arranged for detachable connection with corresponding electrical contacts of at least one plugs, said first electrical contacts comprising a first data pair for transmitting power between said local area network equipment and at least one LAN node and a second data pair for transmitting data between said local area network equipment and said at least one LAN node;

second electrical contacts for connection with said local area network equipment, said second electrical contacts carrying electrical power for said at least one LAN node for connection via said first data pair;

third electrical contacts for connection with said local area network equipment, said third electrical contacts carrying data for said at least one LAN node for connection via said second data pair; and active power circuitry coupled to at least one of said first data pair and at least one of said second electrical contacts, said active power circuitry comprising voltage measuring circuitry, said voltage measuring circuitry being employable for line interrogation.

26. An active RJ-45 compatible connector housing assembly in accordance with claim 25, wherein said first data pair and said second data pair constitute a single data pair.

27. An active RJ-45 compatible connector housing assembly comprising:

an RJ-45 compatible connector housing for use with local area network (LAN) equipment;

first electrical contacts mounted in said RJ-45 compatible connector housing and arranged for detachable connection with corresponding electrical contacts of at least one RJ-45 compatible plug, said first electrical contacts comprising at least one data pair for transmitting power and data between said local area network equipment and at least one LAN node;

second electrical contacts arranged for connection with electrical contacts of said local area network equipment, said second electrical contacts carrying data for said at least one LAN node for connection via said at least one data pair; and active power circuitry coupled to said at least one data pair, said active power circuitry comprising voltage measuring circuitry, said voltage measuring circuitry being employable for line interrogation.

28. An active local area network connector assembly comprising:

an active connector housing for use with local area network (LAN) equipment;

first electrical contacts mounted in said housing and arranged for detachable connection with corresponding electrical contacts of at least one plugs, said first electrical contacts comprising at least one data pair for transmitting data between said local area network equipment and at least one LAN node;

second electrical contacts for connection with said local area network equipment, said second electrical contacts carrying electrical power for said at least one LAN node; and active power circuitry coupled to said at least one data pair and at least one of said second electrical contacts, said active power circuitry being operative for combining said electrical power far said at least one LAN node to said at least one data pair.

* * * * *

UNITED STATES PATENT AND TRADEMARK OFFICE

CERTIFICATE OF CORRECTION

PATENT NO. : 6,916,206 B2
DATED : July 12, 2005
INVENTOR(S) : Ferentz

It is certified that error appears in the above-identified patent and that said Letters Patent is hereby corrected as shown below:

Title page,
Item [73], Assignee,should read -- PowerDsine, Ltd., Hod Hasharon (IL) --.

Signed and Sealed this

Twenty-seventh Day of September, 2005

JON W. DUDAS
*Director of the United States Patent and Trademark Office*